US007147819B2

(12) United States Patent
Bram et al.

(10) Patent No.: US 7,147,819 B2
(45) Date of Patent: Dec. 12, 2006

(54) METHOD FOR PRODUCING HIGHLY POROUS METALLIC MOULDED BODIES CLOSE TO THE DESIRED FINAL CONTOURS

(75) Inventors: Martin Bram, Jülich (DE); Alexander Laptev, Kramatorsk (UA); Detlev Stöver, Niederzier (DE); Hans Peter Buchkremer, Heinsberg (DE)

(73) Assignee: Forschungszentrum Julich GmbH, Julich (DE)

( * ) Notice: Subject to any disclaimer, the term of this patent is extended or adjusted under 35 U.S.C. 154(b) by 0 days.

(21) Appl. No.: 10/517,118

(22) PCT Filed: May 9, 2003

(86) PCT No.: PCT/DE03/01484

§ 371 (c)(1),
(2), (4) Date: Jul. 11, 2005

(87) PCT Pub. No.: WO03/101647

PCT Pub. Date: Dec. 11, 2003

(65) Prior Publication Data

US 2005/0249625 A1 Nov. 10, 2005

(30) Foreign Application Priority Data

Jun. 3, 2002 (DE) ..... 102 24 671

(51) Int. Cl.
*B22F 3/10* (2006.01)

(52) U.S. Cl. ..... 419/2; 419/37

(58) Field of Classification Search ..... 419/36, 419/37, 2

See application file for complete search history.

(56) References Cited

U.S. PATENT DOCUMENTS 5,308,556 A * 5/1994 Bagley ..... 264/13
5,510,066 A * 4/1996 Fink et al. ..... 264/40.1
5,765,095 A * 6/1998 Flak et al. ..... 419/8
6,524,522 B1 * 2/2003 Vaidyanathan et al. ..... 419/2
6,852,272 B1 * 2/2005 Artz et al. ..... 419/2
2004/0057894 A1 * 3/2004 Klett et al. ..... 423/445 R

FOREIGN PATENT DOCUMENTS

| | | |
|---|---|---|
| DE | 1 150 561 | 6/1963 |
| DE | 197 50 006 | 6/1998 |
| DE | 197 26 961 | 11/1998 |

* cited by examiner

*Primary Examiner*—Daniel Jenkins
(74) *Attorney, Agent, or Firm*—Andrew Wilford

(57) ABSTRACT

The invention relates to a method for producing highly porous, metallic molded bodies. The inventive method consists of the following steps: a metallic powder used as a starting material is mixed with a dummy; a green body is pressed out of the mixture; the green body is subjected to conventional mechanical machining, the dummy advantageously increasing the stability of the green body; the dummy material is thermally separated from the green body by means of air, a vacuum or an inert gas; and the green body is sintered to form the molded body and is then advantageously finished. Suitable materials for the dummy are, for example, ammonium bicarbonate or carbamide. The mechanical machining carried out before the sintering advantageously enables a simple production close to the desired final contours, even for complicated geometries of the molded body to be produced, without impairing the porosity, and without high wear of the tools. The workpiece is advantageously sufficiently stable in terms of pressure for the green machining as the dummy material is still present in the pores of the green body during the machining.

8 Claims, 3 Drawing Sheets

METHOD FOR PRODUCING HIGHLY POROUS METALLIC MOULDED BODIES CLOSE TO THE DESIRED FINAL CONTOURS

CROSS REFERENCE TO RELATED APPLICATIONS

This application is the US national phase of PCT application. PCT/DE03/01484 filed 9 May 2003 with a claim to the priority of German patent application 10224671.8 itself filed 3 Jun. 2002.

FIELD OF THE INVENTION

The invention relates to a process by means of which porous and especially highly porous components can be produced to close to a final contour.

BACKGROUND OF THE INVENTION

The pressing of metal powders for the production of porous metal bodies is known. To produce the desired porosity the so-called place-holder material dummy material can be added to the metal powder to enable the desired porosity to be stabilized. After pressing of the green body from the powder mixture, the place holder material is then removed from the green body so that the green body consists only of the remaining metal powder framework which has spaces within its framework structure. The green body has thus already the porous structure which is later to be found in the molded body. In the driving off of the place-holder material, one must be concerned to maintain the metal powder framework. By means of the subsequent sintering of the base body, a high porosity molded body can be obtained in which the powder particles are diffusion bonded together at their contact surfaces by sintering.

As the place-holder material or dummy material for the formation of porous metallic molded bodies, it is conventional to use relatively high melting organic components which by vaporization or evaporation or pyrolysis (cracking) and the solubilization of the resulting product by means of appropriate solvents can be removed from the green bodies. It is a problem with such materials that significant time is cost by the removal of place-holder materials and cracking products which can react with practically all of the metals used in powder metallurgical processes like titanium, aluminum, iron, chromium, nickel, etc. so that high concentrations of impurities remain. It is also a disadvantage where thermoplasts are used and are to be removed by heating the green body, that the expansion at the glass transition point has a detrimental effect on the requisite stability of the green body.

Alternatively, high melting inorganics, like alkali salts and low melting metals like magnesium, tin, lead, etc. are also used as place holders [dummy materials]. Such place holder materials are removed in vacuum, or under a protective gas at temperatures between about 600° C. to 1000° C. from green bodies at high energy cost and in a time-consuming manner. With such place-holder materials impurities will remain in the green body which may be detrimental especially in the case of molded bodies of reactive metal powders like titanium, aluminum, iron, chromium and nickel.

From DE 196 38 927 C2, a method of making highly porous metallic molded bodies is known in which initially metal powder and a place holder are mixed and then pressed to a green mass. In this operation both uniaxial as well as isostatic pressing can be used. The place holder or dummy is then thermally driven out and the green body then sintered. If the powder-dummy mixture is stabilized with a binder, it is in principle possible to produce even relatively complex component geometries by multiaxial pressing. The fabrication of the pressing dies for this purpose is however expensive and difficult. Especially for small series of pieces it is therefore advantageous to produce semifinished products or blanks with a universal geometry (for example cylinders or plates) and then by subsequent mechanical processing to impart the desired final contour to the product.

According to the present state of the art, the final shape is imparted to highly porous shaped bodies only after the sintering by conventional mechanical methods like for example turning, milling, boring or grinding. It is a disadvantage of these subsequent machining operations that the already sintered blank is connected with a local workpiece deformation. Through the plastic deformation there is usually a smearing of the pores. As a consequence the desired open porosity of the molded body is generally lost precisely in those surface regions at which it is desirable. This has a detrimental effect on the functional characteristics of the molded body. Furthermore, the workpiece, because of its porosity can only be clamped and machined with great care since it is not very stable under compression. The nonuniform surface of the porous molded body gives rise to a relatively high tool wear.

OBJECT OF THE INVENTION

The object of the invention is to provide a simple method of making a high porosity metallic shaped body which can have an especially highly complex geometry, which is free from the aforedescribed drawbacks like the detrimental effect on the porosity at the surface.

SUMMARY OF THE INVENTION

The subject of the invention is a method of making high porosity metallic shaped bodies. The method thus comprises the following method steps: A metal powder to be used as a starting material is mixed with a place holder or dummy. The metal powder can be, for example, titanium and its alloys, iron and its alloys, nickel and its alloys, copper, bronze, molybdenum, niobium, tantalum or tungsten.

The materials suitable as place holders or dummies are for example carbamide $CH_4N_2O(H_2N—CO—NH_2)$, biuret $C_2H_5N_3O_2$, melamine $C_3H_6N_6$, melamine resin, ammonium carbonate $(HN_4)CO_3H_2O$ and ammonium bicarbonate $NH_4HCO_3$, which can be removed without leaving residue at temperatures of up to 300° C. from the green body. Especially advantageous as the place holder material or dummy is ammonium-bicarbonate which can be driven out into the air already at about 65° C. The grain size, that is the particle size, and the particle shape of the place-holder material or dummy determines the porosity to be formed in the molded body. Typical particle diameters of the place holder material or dummy are 50 μl to 2 mm. By suitable choice of the place holder or dummy and the amount of the place holder or dummy with respect to the metal powder, a high, homogeneous and open porosity can be produced in the final molded body. Porosities of up to 90% are achievable without more.

From the mixture a green body, especially a green body with a simple geometry, is pressed. The green body can for example by a cylinder or also a plate. The press process can use multiaxial pressing or cold isostatic pressing. The multiaxial pressing results in a dimensionally stable semiproduct or blank with a defined external contour. The wall friction and demolding results in the formation of a so-called press skin which is formed from plastically deformed metallic particles. This press skin can be removed prior to sintering by mechanical machining to the extent no further green machining is required. The wall friction limits the length-to-diameter ratio to 2:1. Above this value density differences in the pressed body which are too great arise. The cold isostatic pressing is carried out for example in rubber molds. As the pressure transmission medium, an oil-containing emulsion can be used in which the powder filled rubber mold is immersed. Since the wall friction on demolding is thereby eliminated, it is possible to make blanks with a length to diameter ratio greater than 2:1 and with a sufficiently homogeneous density distribution. It is a drawback that the dimensional stability of the outer contour is somewhat limited although this has scarcely any effect on the subsequent green processing.

The green body is then subjected to a conventional mechanical machining in which the workpiece is provided with its final form, with the shrinkage during the sintering process being calculated in. The machining is done in the green state in which the mass still contains the place holder or dummy, with the advantage that the workpiece can be machined very simply and the porosity is not affected. The tool wear is then usually held low. Even highly complex shapes can be imparted with this process. The still present place holder or dummy makes the workpiece to be machined sufficiently stable against compression to enable it to be clamped for the subsequent mechanical machining.

When the final shape has been produced, the plate holder material is removed in air or under vacuum or under a protective gas from the green body thermally. The atmosphere which is used is dependent upon the place holder or dummy material which is selected. For example, air as an atmosphere suffices for the removal of ammonium bicarbonate as the place holder or dummy at a temperature above 65° C. The green body is then sintered to produce the molded product.

The mechanical machining prior to sintering advantageously enables simple production of a molded body close to the final contour even for complicated geometry of the molded body to be produced without detriment to the porosity and without high tool wear.

This process is not limited only to the production of molded bodies with a unitary porosity but it allows for the production of molded bodies with different porosities, for example, graded porosity.

In the use of coarse starting powders generally the single particles have only a weak connection to the sintered network since the sintered bridges are only incomplete. Even with small loads, such bodies generally can break down. This can however be impermissible for certain applications. In order to avoid this detrimental effect, high porosity components from coarse starting powders before use are advantageously trovalized or ground smooth. In this process the weakly adherent particles are usually removed by a grinding step from the surface.

SPECIFIC DESCRIPTION

Figure 1:
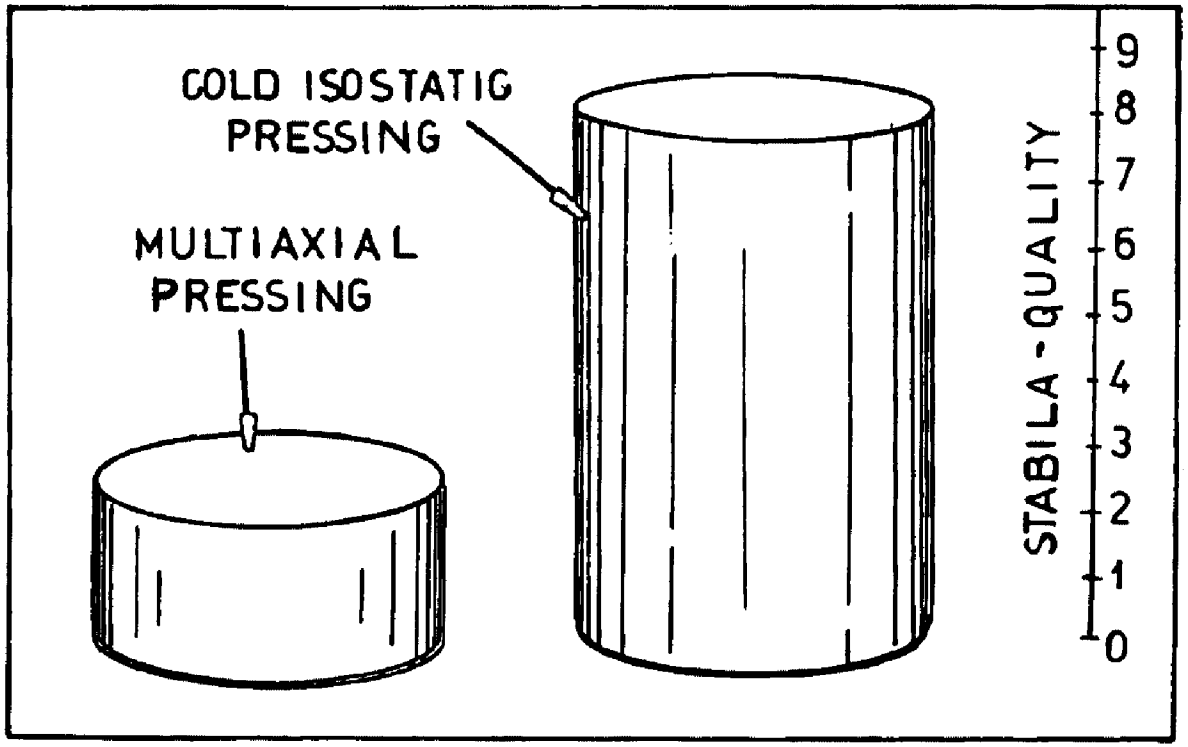
FIG. 1 are respective views of possible embodiments of the semifinished product or blank which are produced by multiaxial pressing and by cold isostatic pressing.

The typical method steps for a method according to the invention are as follows:

1. Initially the blank is made as described in DE 196 38 927. For that purpose metal powder, especially stainless steel 1.4404 (316L) or titanium is mixed with a place holder or dummy, especially ammonium bicarbonate and uniaxially or cold isostatically pressed. The blank, for example a cylinder or a plate, as required for further processing is made with a suitable die. FIG. 1 shows possible embodiments of the blank which are made by multiaxial pressing and by cold isostatic pressing.

2. There follows the green machining of the unsintered blank by conventional mechanical machining operations (sawing, boring, turning, milling, grinding . . . ). The place holder or dummy advantageously increases the green strength of the blank and thus has a positive effect on the machinability. A further advantage of the machining is the low cutting force and thus the limited tool wear. A smearing of the pores is also avoided.

3. The removal of the place holder or dummy and the sintering can be carried out conventionally on a planar sintering surface of ceramic or alternatively in a bed with ceramic balls. The parameters of the removal of the place holder or dummy can be those of DE 196 38 927 C2.

As a complement to DE 196 38 927 C2, it can be noted that the removal of the place holders ammonium carbonate and ammonium bicarbonate can take place in air. The sintering in a ball bed has the advantage that the contact surfaces against the component are limited so that an adhesion of the components to the ceramic balls is prevented. The ball bed easily compensates for the sintering shrinkage by the reorientation of the balls so that a uniform contact with the sintering surface is ensured during the entire sintering process. This avoids distortion of the components made during sintering. As an option the molded body, to improve the surface quality, can then be trovalized.

EXEMPLARY EMBODIMENT

Figure 2:
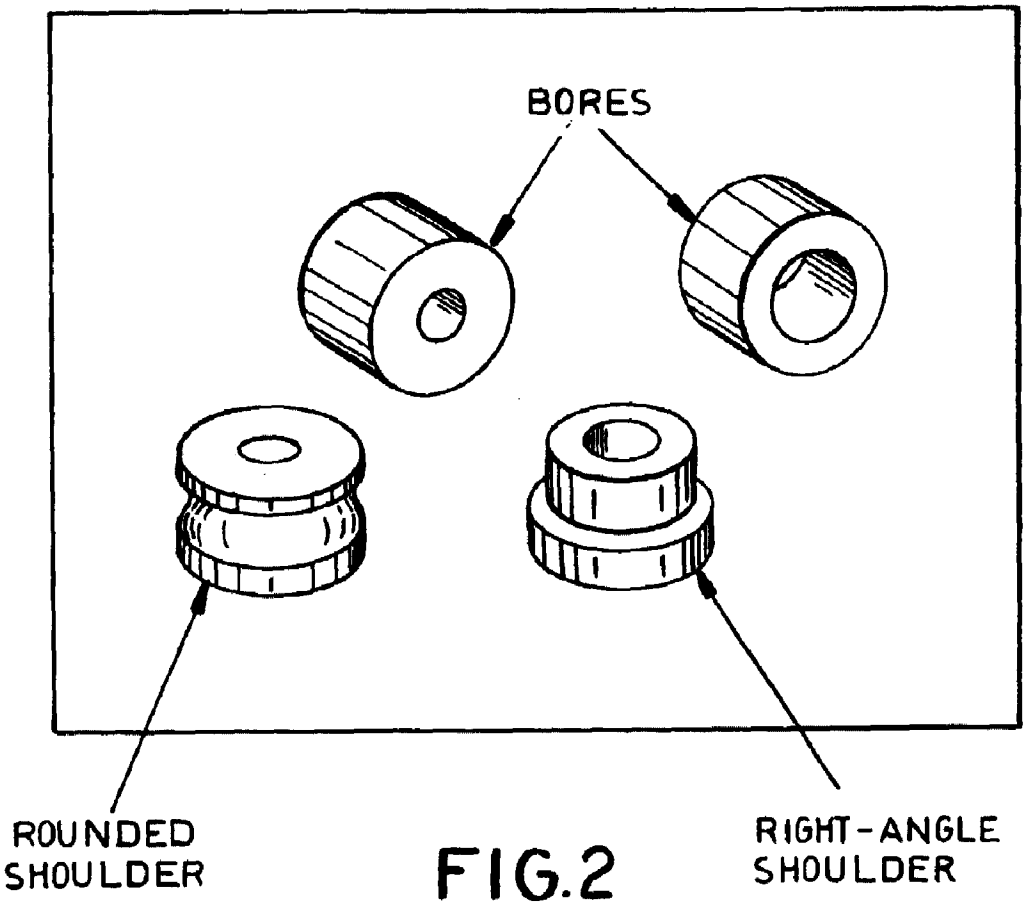
FIG. 2 shows in perspective views, different metal geometries which are made from stainless steel 1.4404 (316L) by the process according to the invention.
Figure 3:
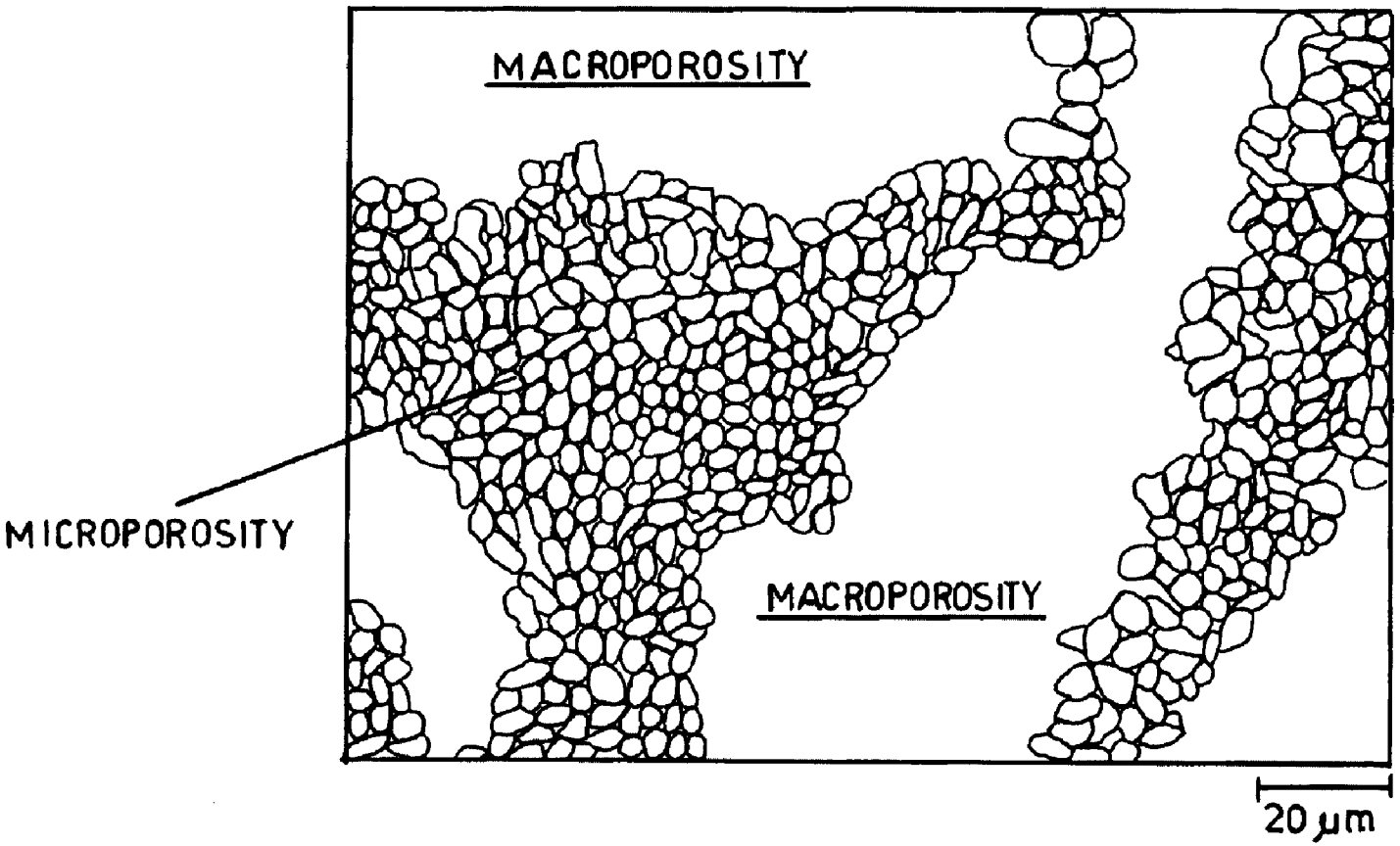
FIG. 3 is a photomicrographic showing the microporosity which is set by the place holder or dummy material and the microporosity within the sintered webs.

FIG. 2 shows different metal geometries which are made from the stainless steel 1.4404 (316L) according to the invention and with the method sequence described in the following. As the starting material a water-atomized powder (grain fraction below 500 μm) was used. The steel powder was mixed with the place holder or dummy ammonium bicarbonate (grain fraction 355 to 500 μm) in a ratio of steel powder to ammonium bicarbonate of 45 to 55 (in volume %). This corresponded to a ratio of steel powder to place holder of 80.5 to 19.5 in weight %. The mixture was uniaxially pressed with a press pressure of 425 MPa to cylinders with a diameter of 30 mm and a height of 22 mm. The cylinders were machined in the green state by turning and drilling. Apart from bores the cylinders can also be provided with right angled and also rounded shoulders in the model geometry. The removal of the place holder ammonium bicarbonate was effected in air at a temperature of 105° C. The decomposition of the place holder or dummy occurred already at 65° C. but the higher temperature was chosen to drive off the decomposition product water in the gaseous state. The sintering was carried out at 1120° C. for two hours under an argon atmosphere. The metal geometry showed a shrinkage of about 4%. The final porosity of the fabricated component was about 60%. It was a result of both the macro porosity established by the place holder material and the micro porosity which developed in the sintered web (FIG. 3). The micro porosity resulted from incomplete sintering of the metal particles. A reduction of the micro porosity could be obtained by the use of finer starting powders or by sintering at higher temperatures.

The invention claimed is:

1. A method of producing a high porosity metallic molded body with the following process steps:

mixing a metal powder used as the starting material with a particulate place holder with a particle size of 50 μm to 2 mm and selected from the group which consists of carbamide, biuret, ammonium carbonate and ammonium bicarbonate to form a mixture, pressing from the mixture consisting essentially of said metal powder and said particulate place holder a green body with a compressive strength sufficient to allow machining thereof, subjecting the green body to a conventional mechanical machining, removing the place holder material thermally from the green body in air or under vacuum or under a protective gas to produce a machined green body with open porosity, and sintering the green body to form the molded body while maintaining the open porosity.

2. The method according to claim 1, in which the place holder is removed at a temperature below 300° C.

3. The method according to claim 1, in which stainless steel 1.4404 (316L) or titanium is used as the metallic starting powder.

4. The method according to claim 1, in which the molded body is produced by sawing, boring, turning, milling or grinding in the green state to close to its final contour.

5. The method according to claim 1, in which the sintering is carried out in a bed of ceramic balls.

6. The method according to claim 1, in which the molded body following sintering is trovalized or ground smooth.

7. The method according to claim 2 wherein the place holder is removed at a temperature below 105° C.

8. The method according to claim 7 in which the place holder is removed at a temperature below 70° C.

* * * * *